US006136110A

United States Patent [19]

Hashimoto et al.

[11] Patent Number: 6,136,110

[45] Date of Patent: Oct. 24, 2000

[54] FERRITIC HEAT-RESISTANT STEEL HAVING EXCELLENT HIGH TEMPERATURE STRENGTH AND PROCESS FOR PRODUCING THE SAME

[75] Inventors: Katsukuni Hashimoto; Hiroyuki Mimura, both of Futtsu; Takashi Sato; Kohji Tamura, both of Kure; Toshio Fujita, 14-4, Mukougaoka 1-chome, Bunkyo-ku, Tokyo, all of Japan

[73] Assignees: Nippon Steel Corporation; Babcock-Hitachi Kabushiki Kaisha; Toshio Fujita, all of Tokyo, Japan

[21] Appl. No.: 08/836,446

[22] PCT Filed: Nov. 2, 1995

[86] PCT No.: PCT/JP96/02249

§ 371 Date: Aug. 18, 1997

§ 102(e) Date: Aug. 18, 1997

[87] PCT Pub. No.: WO96/14445

PCT Pub. Date: May 17, 1996

[30] Foreign Application Priority Data

Nov. 4, 1994 [JP] Japan ..... 6-271625

[51] Int. Cl.[7] ..... C21D 6/02

[52] U.S. Cl. ..... 148/622; 148/579

[58] Field of Search ..... 148/330, 334, 148/574, 622; 420/106, 110, 111, 114

[56] References Cited

U.S. PATENT DOCUMENTS 3,600,161 8/1971 Inouye et al. .

5,084,238 1/1992 Masuyama et al. ..... 420/109

5,362,338 11/1994 Iwama et al. ..... 148/334

5,449,420 9/1995 Okada et al. ..... 148/333

FOREIGN PATENT DOCUMENTS

0411515A1 2/1991 European Pat. Off. .

6-220532 8/1994 Japan .

*Primary Examiner*—John Sheehan

*Attorney, Agent, or Firm*—Kenyon & Kenyon

[57] ABSTRACT

This invention provides a ferritic heat-resistant steel suitable for a pressure-resistant member to be used at a temperature of 400 to 550° C. The ferritic heat-resistant steel having an excellent high temperature strength contains, in terms of wt %, 0.05 to 0.15% of C, 0.10 to 0.08% of Si, 0.20 to 1.5% of Mn, 0.5 to 1.5% of Cr, 0.10 to 1.15% of Mo, 0.005 to 0.30% of V, 0.005 to 0.05% of Nb, 0.0002 to 0.0050% of B, and if necessary, 0.005 to 0.05% of Ti and 0.4 to 1.0% of W, either alone or in combination, and having a structure comprising not greater than 15% of pro-eutectoid ferrite, in terms of a metallic structural area ratio, and the balance of bainite. The present invention provides also a process for producing a ferritic heat-resistant steel having an excellent high temperature strength, comprising tempering the steel having the composition at a temperature within the range 950 to 1,010° C., and conducting tempering while keeping a T.P. value within the range of $18.50\times10^3$ to $19.90\times10^3$.

2 Claims, 2 Drawing Sheets

FERRITIC HEAT-RESISTANT STEEL HAVING EXCELLENT HIGH TEMPERATURE STRENGTH AND PROCESS FOR PRODUCING THE SAME

TECHNICAL FIELD

This invention relates to a ferritic heat-resistant steel. More particularly, it relates to a ferritic heat-resistant steel having an excellent high temperature strength which can be used as a high temperature and high pressure-resistant material at a temperature ranging from 400 to 550° C. in thermal power plants. Speaking more concretely, the present invention improves the structure of carbides and the base metal by adding additional elements and performing heat-treatment, and provides excellent high-temperature strength, excellent machinability and excellent weldability.

BACKGROUND ART

Heat-resistant steels used as high temperature and high pressure-resistant materials in thermal power plants, chemical plants, nuclear power plants, etc., can be broadly classified into austenitic stainless steels and ferritic heat-resistant steels such as a Cr—Mo steel, a Mo steel and a carbon steel. Suitable materials are selected from these heat resistant steels from the aspects of the temperature of the high temperature and high pressure portions, environments and economy.

Among the heat-resistant steels described above, the austenitic stainless steels are most excellent in high temperature strength and the corrosion resistance but it have a large coefficient of linear expansion and a small heat transfer rate. Also, they are susceptible to stress corrosion cracking. Further, they are expensive because the amounts of addition of alloy elements such as Cr, Ni, etc., are large. Therefore, Cr—Mo steels as ferritic heat-resistant steels have been employed in most cases as the high temperature and pressure-resistant members described above with the exception of the case where the temperature of use is not lower than 600° C. or the environment of use is a remarkably corrosive environment. Among the Cr—Mo steels, a Cr—Mo steel having a Cr content of about 1% has high economy, though its high temperature resistance and corrosion resistance are inferior, in comparison with a Cr—Mo steel having a Cr content of at least 2%. On the other hand, it has a higher elevated temperature strength and higher oxidation resistance than the Mo steel and the carbon steel, thought its cost is higher.

A typical example of the material of the Cr—Mo steel having the Cr content of 1% and having such features includes STBA23 (1.25 Cr—0.5 Mo) and STBA22 (1 Cr—0.5 M) according to the JIS standards. These steels can be used at temperatures of up to about 550° C. from the aspect of the oxidation resistance due to their Cr contents. However, since their creep rupture strength is lower than that of the Cr—Mo steel having a Cr content of at least 2%, the thickness must be large and thus the economy is inferior to the Cr—Mo steel having a Cr content of at least 2%.

Therefore, their application range is limited to a pressure-resistant member within a temperature range of 400 to 500° C. In other words, the temperature range of use of the Cr—Mo steel having a Cr content of 1% can be drastically expanded if the high temperature strength of this steel can be improved. From this aspect, the improvement in the strength of the Cr—Mo steel having a Cr content of 1% as a high temperature and high pressure resistant material of the thermal power plants, etc., is necessary.

Though the industrial effect brought forth by the improvement in the strength of the Cr—Mo steel having a Cr content of about 1% is great as described above, the prior art technologies involve the problem that the improvement in the strength invites deterioration of toughness and machinability. The Cr—Mo steel such as STBA23 of the JIS Standards, for example, improves the high temperature strength by solid solution strengthening of Mo and precipitation strengthening of fine carbides such as Cr, Fe and Mo. When these additional elements are alone used, however, pro-eutectoid ferrite exceeds 50%, a sufficient tensile strength cannot be obtained in an intermediate temperature range, coarsening of carbides is quick, and a long-term creep strength cannot be sufficiently obtained.

On the other hand, Japanese Examined Patent Publication (Kokoku) No. 63-18038 discloses a low alloy steel having excellent creep characteristics and excellent hydrogen permeation resistance. However, though at least 0.75% of Mo and at least 0.65% of W are substantially added in addition to the Cr content of at least 2%, this prior art does not at all consider weldability of the steel which is very important for utilization and machining. Further, the material of this reference is subjected to annealing treatment at a temperature of 1,050° C. to increase the strength, but in the case of heat transfer pipes of the thermal power plant, there occur many cases where water cooling annealing cannot be carried out from the aspect of heat-treatment. Therefore, the steel yet has a problem in working.

DISCLOSURE OF INVENTION

It is an object of the present invention to provide a ferritic heat-resistant steel which makes the most of the characteristics of the Cr—Mo steel having a Cr content of about 1%, adds further V, Nb and B, and suitable amounts of Ti and W, whenever necessary, and has an excellent high temperature strength such that it can be used as a pressure-resistant material within a broad temperature range of 400 to 550° C., by applying heat-treatment suitable for the component composition thereof.

The present invention obtains excellent high temperature strength, workability and weldability by adding additional elements to the structure of the carbides and the base metal and carrying out heat-treatment of the structure so as to exploit the excellent characteristics of the Cr—Mo steel. In order to make it possible to use a Cr—Mo steel having a Cr content of 1% at a higher temperature, the present invention adds V an Nb as precipitation strengthening elements to improve the high temperature strength, adds B for regulating a matrix structure and further adds, whenever necessary, W and Ti, to the steel. Furthermore, the present invention provides normalizing and tempering conditions suitable for the steel composition in order to make the best of the characteristics of the present invention.

In other words, the present invention provides a ferritic heat-resistant steel having excellent high temperature strength, and having a structure comprising, in terms of wt %.

C: 0.05 to 0.15%,
Mn: 0.20 to 1.5%,
Mo: 0.10 to 1.15%,
Nb: 0.005 to 0.05%,
Si: 0.10 to 0.80%,
Cr: 0.5 to 1.5%,
V: 0.005 to 0.30%,
B: 0.0002 to 0.0050%,
and further comprising one, or both of:

Ti: 0.005 to 0.05%,

W: 0.4 to 1.0%, and pro-eutectoid ferrite having a metallic structural area ratio of not greater than 15%, and the balance of bainite.

The present invention also provides a process for producing a ferritic heat-resistant steel having excellent high temperature strength which comprises melting and plastic working the steel having the composition described above, normalizing the steel at a temperature within the range of 950 to 1,010° C., and subsequently tempering the steel within the range where T.P. value expressed by the equation below, in consideration of the suitable balance between mechanical characteristics of the steel, is from $18.50\times10^3$ to $20.90\times10^3$:

$$T.P.=T(20+\log t)$$

where

T: tempering temperature (K), t: tempering time (hr).

BEST MODE FOR CARRYING OUT THE INVENTION

Figure 1:
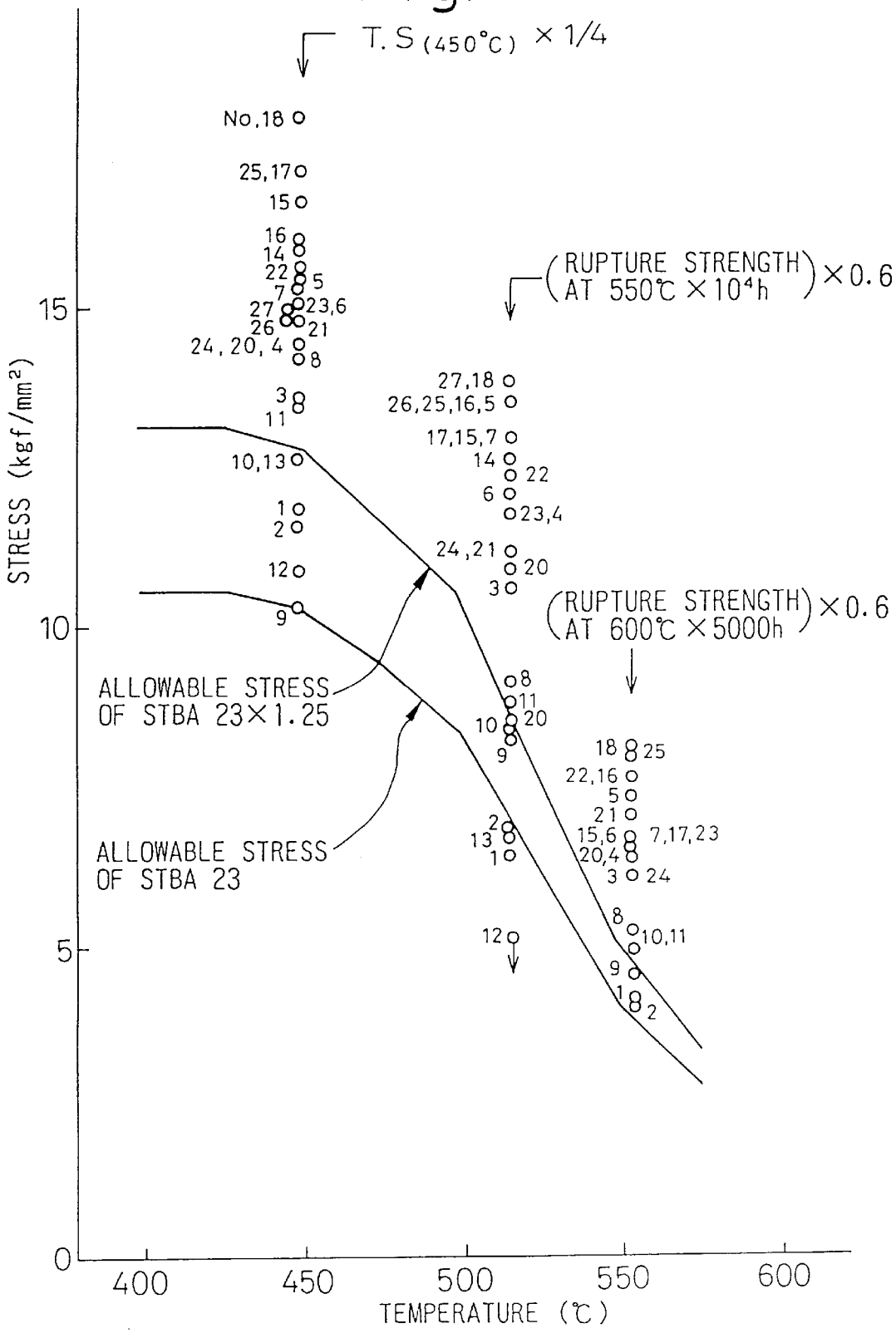
FIG. 1 is a diagram wherein an allowable stress of STBA23 as a Comparative Steel and data of the steel of this invention are plotted in accordance with "Technical Standard for Thermal Power Generation Setup".

The present invention optimizes the structure of the carbides and the base metal inside the steel by the combination of additional alloy elements and heat-treatment of the steel. In order to improve the excellent characteristics of Cr—Mo steels in this instance, that is, to improve its high temperature strength, the present invention adds V and Nb as precipitation strengthening elements, and to regulate the matrix structure, the invention adds B. Further, the invention adds W and Ti, whenever necessary. Further, to make the most of the characteristics of the invention, the present invention accomplishes normalizing and tempering conditions suitable for the steel composition.

Hereinafter, the function and effect of each element and the reasons for limitation of each content will be explained.

C forms carbides in combination with Fe, Cr, Mo, V, Nb, W and Ti, contributes to the high temperature strength, and determines the formation ration of the martensite, bainite, pearlite and ferrite structures. If the C content is less than 0.05%, the precipitation quantity of the carbides becomes insufficient and a sufficient strength cannot be obtained. When the C content exceeds 0.15%, on the other hand, the carbides precipitate excessively, and the weldability and the workability deteriorate. Accordingly, a suitable range of the C content is set to 0.05 to 0.15%.

Si must be added as a deoxidizing agent. It is an element necessary for imparting oxidation resistance to the steel. Particularly, to improve the steam oxidation resistance, Si is an essentially necessary element. The effect of the improvement of the oxidation resistance if Si is less than 0.10% within the Cr content of 0.5 to 1.5%. If the Si content exceeds 0.80%, however, toughness drops. Therefore, a suitable range is set to 0.10 to 0.80%.

Mn improves the hot workability of the steel and contributes also to stabilization of the high temperature strength. If the Mn content is less than 0.20%, such effects are remarkably small. If it exceeds 1.5%, however, the steel is hardened, and the weldability as well as the workability deteriorate. Therefore, a suitable range is set to 0.20 to 1.5%.

Cr is an indispensable element to improve the oxidation resistance and the high temperature corrosion resistance of the steel. The steel according to the present invention is used in the temperature range of up to 550° C., but the Cr content of less than 0.5% is not practical from the aspects of the oxidation resistance and the corrosion resistance. The corrosion resistance can be improved by increasing the Cr content, but weldability drops. Therefore, its suitable range is set to 0.5 to 1.5%.

Mo becomes a solid solution with the base iron and strengthens the matrix. Since a part of the Mo precipitates as carbides, the high temperature strength increases. If the Mo content is less than 0.10%, a substantial effect cannon be obtained. If the Mo content is to great, workability, weldability and oxidation resistance drop, whereas the material cost increases. Therefore, a suitable range is set to 0.10 to 1.15%.

V mainly combines with C to precipitate the carbides, and provides remarkable effects in the high temperature strength, particularly the creep strength. If the amount of addition of V is less than 0.005%, a substantial effect cannot be obtained. If the V content exceeds 0.3% the unsolublized V carbides at the time of solid solution heat-treatment become coarse and lower the effect of V. Therefore, a suitable range is set to 0.005 to 0.30%.

Nb uniformly disperses and precipitates fine carbides, improves the high temperature strength and restricts coarsening of the unsolubilized Nb carbonitrides at the time of solid solution heat-treatment, thereby improving toughness. If the Nb content is less than 0.005%, its substantial effect cannot be obtained and if it exceeds 0.05%, the unsolubilized Nb carbonitrides become coarse, and both strength and toughness drop. Therefore, a suitable range is set to 0.005 to 0.05%.

It is generally known that the addition of a trace amount of B improves hardenability. Besides the effect of promoting martesitic transformation, B provides the effects of dispersing and stabilizing the carbides and promoting bainitic transformation, to thereby improve the strength and toughness. Boron purifies the austenitic grains and contributes to the high temperature strength, particularly the creep strength. If the B content is less than 0.0002%, a substantial effect cannot be obtained and if it exceeds 0.0050%, weldability and workability drop, in addition to remarkable deterioration of hot workability. Therefore, a suitable range is set to 0.0002% to 0.0050%.

W becomes a solid solution with the base iron, strengthens the matrix and partly precipitates as carbides, thereby improving the high temperature strength, in the same way as W. Generally, at least 1% of W is added to Cr—Mo type heat-resistant steels to impart its effect. It has been found out, however, that in the presence of V, the improvement in the high temperature strength, particularly in the creep strength, can be expected even after the addition of not greater than 1% of W. As a result of detailed experiments, the substantial effect of W does not appear if the W content is less than 0.4% even in the presence of V, and the increment of its effect becomes small if the W content exceeds 1.0%. Therefore, a suitable range is set to 0.4 to 1.0%.

Ti is a deoxidizing elements, and is added when deoxidizing elements such as Al, Si, etc., are limited. In the same way as Nb, Ti uniformly disperses and precipitates the fine carbides, improves the high temperature strength and restricts coarsening of the crystal grains of the unsolubilized Ti carbonitrides at the time of solid solution heat-treatment, thereby improving toughness. If the Ti content is less than 0.005%, its substantial effect does not appear, and if it exceeds 0.05%, the unsolublized Ti carbonitrides become coarse, so that both strength and toughness drop. Therefore, a suitable range is limited to 0.005 to 0.05%.

Besides the components described above, the balance of the steel of the present invention consists of Fe and unavoidable impurities. Typical examples of the impurities of the steel are P and S. Preferably, the P content is not great than 0.020% and the S content is not greater than 0.010%. Further, Al as the deoxidizing agent is preferably not greater than 0.030%, and N is not greater than 0.0060%, preferably not greater than 0.0045%.

The structure of the ferritic Cr—Mo steel according to the present invention consists of not greater than 15% of pro-eutectoid ferrite in terms of the metallic structural area ratio and the balance of bainite. The reason for this limitation is a follows. The strength at the normal temperature and at the high temperature drops remarkably with the increase of the quantity of pro-eutectoid ferrite, but when the quantity of pro-eutectoid ferrite exceeds 15%, the strength characteristics conditions as stipulated in the present invention cannon be secured. Therefore, the structure limitation condition is set to not greater than 15% of pro-eutectoid ferrite in terms of the metallic structural area ratio and the balance of bainite.

By the way, the characteristics targets in the present invention are listed below.

Allowable stress at normal temperature of 550° C.:

at least 1.25 times the allowable stress of STBA23

Impact value at normal temperature:

at least 4 kgf-m

The heat-treatment conditions for accomplishing these values are attained by carrying out normalizing and tempering in the following way:

Normalizing temperature: 950 to 1,010° C.

Tempering parameter (T.P.) for tempering:

$$18.50\times10^3 \text{ to } 20.90\times10^3$$

$$[T.P.=T(20+\log t)]$$

where

T: heat-treatment temperature (K), t: retention time of heat-treatment (hr).

The heat-treatment condition range is limited as described above because if the normalizing temperature is less than 950° C., a required strength after PWHT (post weld heat treatment) at the time of working for utilization cannot be obtained and if it exceeds 1,010° C., a required toughness value cannot be obtained. Further, if the tempering parameter for tempering is less than $18.50\times10^3$, a required toughness cannot be obtained when PWHT is not applied at the time of working for utilization and if it exceeds $20.90\times10^3$, a required strength cannot be obtained when PWHT is applied at the time of working for utilization.

Hereinafter, the present invention will be explained in further detail with reference to Examples thereof.

EXAMPLES

Sample steels (20 mm thick), each having a chemical composition shown in Table 1 or 2, were produced. After normalizing was carried out at 900 to 1,025° C., heat-treatment was conducted as tempering and PWHT treatment at the time of working for utilization at 650 to 740° C. for 1 to 4 hours. In Tables 1 and 2, steels Nos. 3 to 8, 14 to 16 and 20 to 23 represented by circles ○ were the steels of the present invention, and other steels represented by X were Comparative Steels. The characteristics of the components were described in "Remarks". By the way, Comparative Steels Nos. 1 and 2 were JIS STBA23 and STBA22 and were typical examples of existing Cr—Mo steels.

TABLE 1

(compositions of sample steels: wt %)

| No. | | C | Si | Mn | P | S | Cr | Mo | W | V | Nb | Ti | B | Al | N | Remarks |
|---|---|---|---|---|---|---|---|---|---|---|---|---|---|---|---|---|
| 1 | X | 0.14 | 0.29 | 0.43 | 0.014 | 0.009 | 1.05 | 0.51 | — | — | — | — | — | 0.005 | 0.0038 | STBA 22 |
| 2 | X | 0.13 | 0.65 | 0.43 | 0.009 | 0.007 | 1.28 | 0.53 | — | — | — | — | — | 0.006 | 0.0039 | STBA 23 |
| 3 | ○ | 0.06 | 0.75 | 1.32 | 0.009 | 0.005 | 1.40 | 0.64 | — | 0.17 | 0.019 | — | 0.0031 | 0.007 | 0.0035 | C lower limit |
| 4 | ○ | 0.09 | 0.11 | 0.85 | 0.009 | 0.005 | 1.49 | 0.49 | — | 0.17 | 0.019 | — | 0.0031 | 0.007 | 0.0039 | Si lower limit |
| 5 | ○ | 0.14 | 0.50 | 0.22 | 0.008 | 0.005 | 1.49 | 0.60 | — | 0.24 | 0.013 | — | 0.0026 | 0.010 | 0.0041 | Mn lower limit |
| 6 | ○ | 0.14 | 0.75 | 1.50 | 0.009 | 0.006 | 0.52 | 0.59 | — | 0.18 | 0.014 | — | 0.0030 | 0.007 | 0.0045 | Cr lower limit |
| 7 | ○ | 0.13 | 0.30 | 1.47 | 0.007 | 0.007 | 1.46 | 0.14 | — | 0.29 | 0.006 | — | 0.0006 | 0.030 | 0.0030 | Mo, Nb, B lower limit |
| 8 | ○ | 0.12 | 0.30 | 1.00 | 0.009 | 0.006 | 1.32 | 0.62 | — | 0.006 | 0.006 | — | 0.0030 | 0.004 | 0.0028 | V Lower limit |
| 9 | X | 0.04 | 0.09 | 1.21 | 0.007 | 0.007 | 1.19 | 0.52 | — | 0.17 | 0.012 | — | 0.0030 | 0.010 | 0.0035 | C, Si below lower limit |
| 10 | X | 0.09 | 0.25 | 0.18 | 0.007 | 0.009 | 1.10 | 0.52 | — | 0.15 | 0.015 | — | 0.0016 | 0.006 | 0.0035 | Mn below lower limit |
| 11 | X | 0.08 | 0.55 | 0.88 | 0.007 | 0.007 | 0.45 | 0.49 | — | 0.14 | 0.016 | — | 0.0022 | 0.006 | 0.0036 | Cr below lower limit |
| 12 | X | 0.11 | 0.30 | 1.05 | 0.007 | 0.005 | 1.23 | 0.09 | — | 0.003 | 0.016 | — | 0.0035 | 0.005 | 0.0039 | Mo, V below lower limit |
| 13 | X | 0.08 | 0.55 | 0.80 | 0.007 | 0.005 | 1.00 | 0.25 | — | 0.17 | — | — | 0.0001 | 0.006 | 0.0043 | Nb, B below lower limit |
| 14 | ○ | 0.14 | 0.75 | 1.49 | 0.009 | 0.005 | 0.52 | 0.52 | — | 0.17 | 0.012 | — | 0.0012 | 0.006 | 0.0045 | C, Si, Mn upper limit |
| 15 | ○ | 0.09 | 0.30 | 0.30 | 0.007 | 0.008 | 1.45 | 0.64 | — | 0.18 | 0.045 | — | 0.0015 | 0.008 | 0.0038 | Cr, Nb, upper limit |

TABLE 1-continued

| No. | C | Si | Mn | P | S | Cr | Mo | W | V | Nb | Ti | B | Al | N | Remarks |
|---|---|---|---|---|---|---|---|---|---|---|---|---|---|---|---|
| | (compositions of sample steels: wt %) | | | | | | | | | | | | | | |

○: steels of this invention
X: comparative steels

TABLE 2

| No. | | C | Si | Mn | P | S | Cr | Mo | W | V | Nb | Ti | B | Al | N | Remarks |
|---|---|---|---|---|---|---|---|---|---|---|---|---|---|---|---|---|
| | | -continued to TABLE 1— (compositions of sample steels: wt %) | | | | | | | | | | | | | | |
| 16 | ○ | 0.09 | 0.30 | 1.21 | 0.008 | 0.006 | 1.18 | 0.52 | — | 0.28 | 0.015 | — | 0.0048 | 0.007 | 0.0036 | V, B upper limit |
| 17 | X | 0.16 | 0.82 | 1.66 | 0.007 | 0.006 | 1.25 | 0.49 | — | 0.17 | 0.016 | — | 0.0029 | 0.006 | 0.0035 | C, Si, Mn above upper limit |
| 18 | X | 0.12 | 0.30 | 1.15 | 0.009 | 0.006 | 1.75 | 0.69 | — | 0.38 | 0.018 | — | 0.0029 | 0.007 | 0.039 | Cr, V above upper limit |
| 19 | X | 0.12 | 0.31 | 1.15 | 0.009 | 0.005 | 1.25 | 0.55 | — | 0.17 | 0.017 | — | 0.0085 | 0.007 | 0.0035 | B above upper limit |
| 20 | ○ | 0.10 | 0.32 | 1.02 | 0.009 | 0.006 | 1.25 | 0.55 | — | 0.14 | 0.006 | 0.025 | 0.0035 | 0.004 | 0.0029 | Ti addition |
| 21 | ○ | 0.10 | 0.32 | 1.00 | 0.008 | 0.005 | 1.25 | 0.35 | 0.42 | 0.17 | 0.012 | — | 0.0029 | 0.005 | 0.0045 | W addition |
| 22 | ○ | 0.07 | 0.29 | 0.82 | 0.005 | 0.004 | 1.15 | 0.12 | 0.85 | 0.17 | 0.007 | 0.015 | 0.0032 | 0.005 | 0.0035 | W + Ti addition |
| 23 | ○ | 0.09 | 0.75 | 0.45 | 0.006 | 0.005 | 0.75 | 0.15 | 0.42 | 0.19 | 0.008 | 0.025 | 0.0029 | 0.005 | 0.0029 | -do— |
| 24 | X | 0.12 | 0.32 | 1.05 | 0.006 | 0.006 | 1.25 | 0.50 | — | 0.19 | 0.008 | 0.062 | 0.0015 | 0.005 | 0.0030 | Ti above upper limit |
| 25 | X | 0.12 | 0.75 | 1.05 | 0.006 | 0.005 | 1.25 | 0.35 | 1.20 | 0.19 | 0.012 | — | 0.0015 | 0.005 | 0.0032 | W above upper limit |
| 26 | ○ | 0.09 | 0.30 | 0.50 | 0.007 | 0.004 | 1.24 | 1.04 | — | 0.19 | 0.016 | — | 0.0030 | 0.005 | 0.0032 | Mo upper limit |
| 27 | X | 0.11 | 0.32 | 1.20 | 0.007 | 0.005 | 1.32 | 1.24 | — | 0.22 | 0.025 | — | 0.0030 | 0.005 | 0.0035 | Mo above upper limit |

○: steels of this invention
X: comparative steels

Tables 3 and 4 represent the heat-treatment conditions, the high temperature tensile characteristics, the impact characteristics, the creep rupture strength and the welding low temperature crack prevention pre-heating temperature. Incidentally, the high temperature tensile test and the creep rupture test were carried out using testpieces of ϕ6 mm×GL 30 mm, and evaluation of the welding low temperature crack prevention pre-heating temperature was conducted using slant y type weld crack testpieces.

FIG. 1 shows the high temperature tensile strength and the creep rupture strength among the characteristic values by converting them to allowable stresses in accordance with the JIS and plotting them. As to the creep rupture strength, 550° C.×10,000 hr and 600° C.×5,000 hr in Tables 3 and 4 were converted to $10^5$ hr rupture-corresponding temperature in terms of the Larson & Miller parameter. The Larson & Miller parameter (L.M.P.) hereby used was expressed by the equation (1) given below and its conversion formula is given by the equation (2). In the diagram, the allowable stress values of STBA23 of the Comparative Steels and the values 1.25 times the allowable stress values of STBA23 as the target lower limit allowable stress values of the steels of the present invention were represented by solid lines as the reference values.

$$L.M.P.=T_T(20+\log tr) \quad (1)$$

where $T_T$: test temperature (K), $t_r$: test time $$T_1=T_2(20+\log t_2)\div(20+\log T_1) \quad (2)$$

where $T_1$: $10^5$ h rupture-corresponding temperature (K)

$T_1$: $10^5$ $T_2$ and $t_2$: known temperature (K) and time (hr).

In the case of 550° C.×10,000 hr in this Example, $T_2$ was 823 and $t_2$ was 10,000 and in the case of 600° C.×5,000 hr, $T_2$ was 873 and $t_2$ was 5,000.

The L.M.P., which has the same form as the Tempering parameter, indicates the relationship between the temperature and the time in the creep rupture test, and the tempering conditions can be determined from the Tempering parameter.

Figure 2:
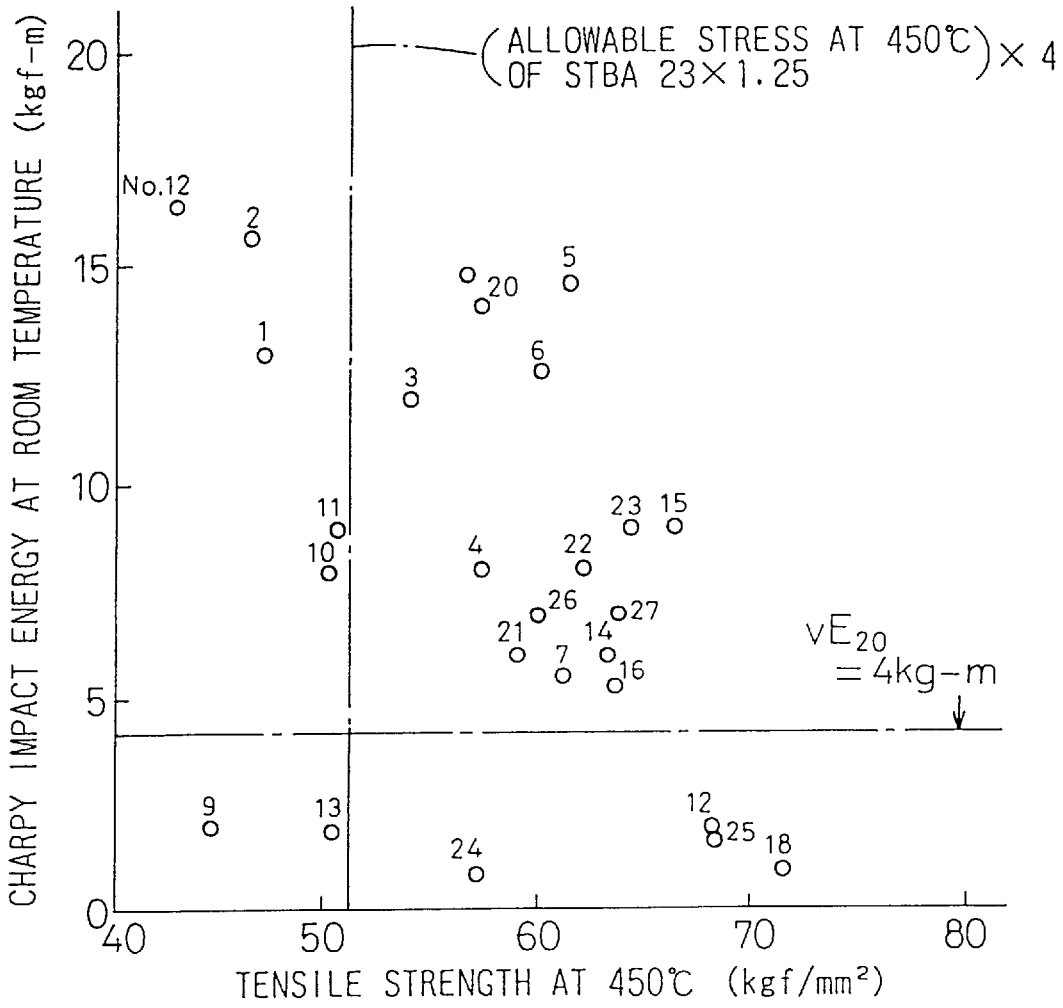
FIG. 2 is a diagram which shows the relationship between a high temperature strength at 450° C. and an impact value for each of the steels of this invention and the Comparative Steel.

FIG. 2 shows the tensile strength at 450° C. among the characteristics of the Examples in contrast to the impact absorption energy at the room temperature. In the diagram, the target lower limit values of the steels of the present invention were represented by broken line as reference values.

In the steels Nos. 3 to 8 of the present steels, each of the components C, Si, Mn, Cr, Mo, V, Nb and B was close to the lower limit of the range of the present invention, and the tensile strength and the creep rupture strength of each of these steels were higher than those of the Comparative Steels Nos. 1 and 2, and their impact value and welding low temperature crack prevention pre-heating temperature were also comparable. In the steels Nos. 9 and 13, each of the components C, Si, Mn, Cr, Mo, V, Nb and B was below the lower limit of the range of the present invention, and their tensile strength and creep rupture strength were remarkably lower than those of the steels of the present invention. In the steels Nos. 14 to 16, each of the C, Si, Mn, Cr, V, Nb and B components was close to the upper limit of the range of the present invention. However, their tensile strength and creep rupture strength were even higher than those of the steels Nos. 3 to 8 of the present steels, and their impact value and welding low temperature crack prevention pre-heating temperature were comparable to the Comparative Examples Nos. 1 and 2. In the steels Nos. 17 to 19, each of the C, Si, Mn, Cr, V, Nb and B components was above the upper limit of the range of the present invention. Though the tensile strength and the creep rupture strength of the steels Nos. 17 and 18 were high, the impact value and the welding low temperature crack prevention pre-heating temperature were inferior to those of the Comparative Steels Nos. 1 and 2. In the steel No. 19, hot workability dropped so remarkably that it could not be subjected to the crack test at the time of hot rolling. The steels Nos. 20 to 23 were those steels to which Ti and W were added either along or in combination. However, the tensile strength and the creep rupture strength were high, and the impact value and the welding low temperature crack prevention pre-heating temperature were also comparable to those of the Comparative Steels Nos. 1 and 2. In the steels Nos. 24 and 25, Ti and W exceeded the upper limit of the range of the present invention. Though their tensile strength and creep rupture strength were high, their impact value and the welding low temperature crack prevention pre-heating temperature were inferior to those of the Comparative Steels Nos. 1 and 2.

In the steel No. 26. Mo component was close to the upper limit of the range of present invention. This tensile strength, creep rupture strength and low temperature crack prevention pre-heating temperature were same as those of the comparative steels Nos. 14 to 16.

In the steel No. 27, Mo component was above the upper limit of the range of present invention. This low temperature crack prevention pre-heating temperature was inferior to those of the comparative steels Nos. 1 and 2.

Further, the steels Nos. 8-1 to 8-4 and Nos. 15-1 to 16-1 corresponded to the steels Nos. 8, 15 and 16 whose heat-treatment conditions were changed. Since the normalizing temperature of the steel No. 8-1 was below the lower limit of the steel of the present invention, its tensile strength and creep rupture strength were low. Since the tempering parameter was above the upper limit of the steel of the present invention in the steel No. 8-4, the creep rupture strength was low. In the steel No. 15-2, on the other hand, the normalizing temperature exceeded the upper limit of the steel of the present invention. Therefore, though the tensile strength and the creep rupture strength were high, the impact value was low and ductility dropped, too. Consequently, the machinability problem remained. Since the tempering parameter of the steel No. 16-1 was below the lower limit of the steel of the present invention, the impact value was low and ductility dropped, too, though the tensile strength and the creep rupture strength were high. Therefore, the workability problem remained.

TABLE 3

| steel No. | | heat-treatment condition: normalizing temperature (° C.) | heat-treatment condition: tempering parameter ($\times 10^{-3}$) | tensile characteristics at 450° C.: TS (kgf/mm$^2$) | tensile characteristics at 450° C.: elongation at break (%) | impact value at room temperature (kgf – m) | creep rupture stress at 550° C. × 10,000 hr (kgf/mm$^2$) | creep rupture stress at 600° C. × 5,000 hr (kgf/mm$^2$) | low temperature crack prevention pre-heating temperature (° C.) |
|---|---|---|---|---|---|---|---|---|---|
| 1 | X | 910 | 20.05 | 47.2 | 32 | 13.0 | 10.5 | 6.6 | 200 |
| 2 | X | | | 46.6 | 33 | 15.5 | 11.2 | 6.5 | 200 |
| 3 | ○ | 980 | 20.42 | 54.2 | 31 | 12.0 | 17.5 | 10.0 | 150 |
| 4 | ○ | | | 57.5 | 28 | 8.0 | 19.5 | 10.5 | 175 |
| 5 | ○ | | | 61.6 | 27 | 14.5 | 22.5 | 12.0 | 200 |
| 6 | ○ | | | 60.2 | 26 | 12.5 | 20.0 | 11.0 | 200 |
| 7 | ○ | | | 61.2 | 24 | 5.4 | 21.5 | 12.0 | 175 |
| 8 | ○ | | | 56.7 | 32 | 14.5 | 15.0 | 8.5 | 175 |
| 9 | X | | | 44.8 | 34 | 1.9 | 13.5 | 7.4 | 125 |
| 10 | X | | | 50.3 | 33 | 8.0 | 13.9 | 8.0 | 150 |
| 11 | X | | | 50.7 | 29 | 9.0 | 14.5 | 8.0 | 150 |
| 12 | X | | | 43.0 | 31 | 16.3 | <5.0 | — | 125 |
| 13 | X | | | 50.5 | 28 | 1.8 | 11.0 | — | 175 |
| 14 | ○ | | | 63.5 | 25 | 6.0 | 21.0 | 10.6 | 200 |
| 15 | ○ | | | 66.4 | 22 | 9.0 | 21.5 | 11.0 | 200 |
| 16 | ○ | | | 63.8 | 22 | 5.2 | 22.5 | 12.5 | 200 |
| 17 | X | | | 67.2 | 19 | 1.9 | 21.5 | 11.0 | 250 |

○: steels of this invention
X: Comparative Steels

TABLE 4

TABLE 2 (continued)

| tensile characteristics at | impact | creep rupture | creep rupture | low temperature crack |
|---|---|---|---|---|

| steel No. | | heat-treatment condition normalizing temperature (° C.) | tempering parameter (× $10^{-3}$) | 450° C. TS (kgf/mm²) | elongation at break (%) | value at room temperature (kgf − m) | stress at 550° C. × 10,000 hr (kgf/mm²) | stress at 600° C. × 5,000 hr (kgf/mm²) | prevention pre-heating temperature (° C.) |
|---|---|---|---|---|---|---|---|---|---|
| 18 | X | 980 | 20.42 | 71.5 | 17 | 0.9 | 23.0 | 13.2 | 250 |
| 19 | X | | | — | — | — | — | — | — |
| 20 | ○ | | | 57.5 | 27 | 14.0 | 18.0 | 10.5 | 175 |
| 21 | ○ | | | 59.2 | 26 | 6.0 | 18.5 | 11.5 | 175 |
| 22 | ○ | | | 62.2 | 24 | 8.0 | 20.5 | 12.5 | 175 |
| 23 | ○ | | | 64.4 | 25 | 9.0 | 19.5 | 12.0 | 175 |
| 24 | X | | | 57.2 | 26 | 0.8 | 18.5 | 10.0 | 175 |
| 25 | X | | | 68.3 | 24 | 1.6 | 22.5 | 13.0 | 250 |
| 26 | ○ | | | 60.4 | 24 | 7.2 | 22.5 | 13.0 | 200 |
| 27 | X | | | 63.2 | 21 | 6.8 | 23.0 | 13.5 | 250 |
| 8-1 | X | 935 | 20.42 | 50.0 | 34 | 16.8 | 13.5 | 7.0 | — |
| 8-2 | ○ | 965 | 20.42 | 54.2 | 32 | 15.2 | 14.5 | 8.0 | — |
| 8-3 | ○ | 995 | 20.42 | 58.9 | 28 | 6.7 | 15.5 | 9.0 | — |
| 8-4 | X | 980 | 20.87 | 52.6 | 30 | 15.0 | 13.9 | 8.5 | — |
| 15-1 | ○ | 995 | 20.42 | 68.9 | 21 | 6.3 | 22.5 | 11.0 | — |
| 15-2 | X | 1025 | 20.42 | 70.6 | 19 | 1.3 | 23.5 | 11.0 | — |
| 16-1 | X | 980 | 18.46 | 78.8 | 16 | 0.8 | 24.5 | 12.5 | — |

○: steels of this invention
X: Comparative Steels

INDUSTRIAL APPLICABILITY

The present invention provides a ferritic heat-resistant steel having an excellent high temperature strength which can be used in a temperature range of 400 to 550° C. This steel has an excellent high temperature strength and moreover, its weldability and bending workability are equal to those of conventional ferritic heat-resistant steels. Due to these characteristics and its cost, the steel of the present invention can be broadly utilized for pressure-resistant members of thermal power plants, and the industrial effects of the invention are extremely great.

What is claimed is:

1. A process for producing a ferritic heat-resistant steel comprising:

providing a steel having a composition comprising, in terms of weight percent,

C: 0.05 to 0.15%,
Mn: more than 0.50 to 1.5%,
Mo: 0.10 to 1.15%,
Nb: 0.005 to 0.05%,
Si: 0.10 to 0.80%,
Cr: 0.5 to 1.5%,
V: 0.005 to 0.30%,
B: 0.0002 to 0.0050%,
and the balance of Fe and unavoidable impurities;

softening said steel by the steps of first normalizing said steel at a temperature within the range of 950 to 1,010° C.; and immediately after said normalizing, carrying out tempering while keeping a T.P. value, expressed by the following formula, within the range of $18.50\times10^3$ to $20.90\times10^3$:

$$T.P.=T(20+\log t)$$

where

T: tempering temperature (K),
t: tempering time (hr);

thereby providing said steel with a structure comprising not greater than 15% by area of pro-eutectoid ferrite and the balance of bainite.

2. A process for producing a ferritic heat-resistant steel comprising:

providing a steel having a composition comprising, in terms of weight percent,

C: 0.05 to 0.15%,
Mn: 0.20 to 1.5%,
Mo: more than 0.50 to 1.15%,
Nb: 0.005 to 0.05%,
Ti: 0.005 to 0.05%,
Si: 0.10 to 0.80%,
Cr: 0.5 to 1.5%,
V: 0.005 to 0.30%,
B: 0.0002 to 0.0050%,
and the balance of Fe and unavoidable impurities;

softening said steel by the steps of first normalizing said steel at a temperature within the range of 950 to 1,010° C.; and immediately after said normalizing, carrying out tempering while keeping a T.P. value, expressed by the following formula, within the range of $18.50\times10^3$ to $20.90\times10^3$:

$$T.P.=T(20+\log t)$$

where

T: tempering temperature (K),
t: tempering time (hr);

thereby providing said steel with a structure comprising not greater than 15% by area of pro-eutectoid ferrite and the balance of bainite.

* * * * *